United States Patent [19]

Kaiser

[11] Patent Number: 4,607,739

[45] Date of Patent: Aug. 26, 1986

[54] COIN ACTIVATED TIMER MECHANISM

[75] Inventor: Bernhard Kaiser, Villingen-Schwenningen, Fed. Rep. of Germany

[73] Assignee: Kienzle Apparate GmbH, Villingen, Fed. Rep. of Germany

[21] Appl. No.: 601,056

[22] Filed: Apr. 16, 1984

[30] Foreign Application Priority Data

Apr. 19, 1983 [DE] Fed. Rep. of Germany ..... 3314077

[51] Int. Cl.[4] ..... G07F 17/24

[52] U.S. Cl. ..... 194/227; 194/337

[58] Field of Search ..... 194/1 L, 102, DIG. 21, 194/DIG. 22, 227, 337

[56] References Cited

U.S. PATENT DOCUMENTS 3,391,772 7/1968 Kaiser et al. ..... 194/DIG. 22

3,828,907 8/1974 Bock ..... 194/DIG. 22

FOREIGN PATENT DOCUMENTS 920222 3/1963 United Kingdom .

1387310 3/1975 United Kingdom .

*Primary Examiner*—F. J. Bartuska

*Attorney, Agent, or Firm*—Toren, McGeady, Stanger, Goldberg & Kiel

[57] ABSTRACT

A coin activated timer mechanism particularly useful as a parking meter including a sensing device for sensing the value of coins received in a coin receiving device in order to actuate through a transmission lever a time indicator mechanism which includes a timer disc rotatable in individual angular steps for providing an indication of a time period dependent upon the value of the coins received. A clockwork mechanism returns the time indicator mechanism to a position indicating expiration of the time period and a function lever operates to effect actuation of the timer disc through the individual angular steps. The function lever is driven by the transmission lever to a position at which the time indicator mechanism is released with the timer disc being simultaneously guided to a position indicating a determined time allotment.

9 Claims, 3 Drawing Figures

COIN ACTIVATED TIMER MECHANISM

The present invention is directed to a device for enabling setting of a timer mechanism to different time units and for clearing the indicator of said mechanism of a determined time period in a time switching device which is particularly useful for a parking meter.

Devices of the type to which the present invention relates usually comprise a receiving device for receiving and identifying individual coins in accordance with the value thereof. A clockwork mechanism is provided which is windable during actuation and the indicator device is adapted to be adjusted to a determined time period after the insertion of a quantity of coins. The indicator device may be readjusted or reset in conformity to an expired period of time by means of the clockwork mechanism.

For example, in automatic cashier parking meters of the conventional type, or in coin operated telephones or similar devices, it is known to operate the device by the insertion of coins in order to achieve an allocation of time units determined in accordance with the value of the coin. As a rule, an insertion slot is provided within which coins may be placed and different coins may be inserted in accordance with the type of coin involved and the value of the coin. Usually, a coin sensing or value determining element is arranged behind the insertion slot.

When a coin passes the checking or sensing element, it is recognized as a redeemable coin and a time unit proportioned to the money value of the inserted coin will be immediately assigned by means of a time switching mechanism. The assigned value is immediately indicated on a visible time scale as is usual, for example, in parking meters.

In addition to the foregoing, there are also devices of this type where only one inserting slot and one coin checking device are provided which nevertheless receive and check coins of different sizes and value. In such devices, an inserted coin will pass checking stations and will be moved by means of a transporting wheel or through the actuation of a hand lever. The coin will operate to set an indicator on a time scale to an allotted time when the coin is recognized as an acceptable coin by the checking station. Only then is it possible to insert an additional coin which may have a different value in order to obtain an additional unit of time.

In the indication of the allotted time, the added time segment may be observed usually due to the fact that the indicator is switched or stepped forward by an additional time unit dependent upon the value of the coin or is adjusted only to a maximum allowable parking time unit in a supplementary manner.

In any case, the device described will almost always involve a combined coin checking and time allotment arrangement which continuously adjusts the indicating mechanism for the time allotment by a corresponding proportioned amount. This will occur, as a rule, each time that a redeemable coin is inserted so long as the maximum allowable time is not reached or exceeded.

A device of this type having a combined coin checking and simultaneous time allotment device is disclosed in the structural form of a parking meter in DE-C No. 14 74 805. In this device, the coins are guided past a sensing lever by means of a transporting device and the sensing lever rotates a dial or adjusting disc in accordance with the diameter of the coin. Cam elements are arranged on the dial so as to be adjustable and their position in the circumferential direction operates as a measurement of the diameter of the allowable coins while their overhang or projection in the radial direction is a measurement of the time allotted. The cam elements are sensed by a sensing device with respect to their overhang height and the indicator mechanism is adjusted to a determined time which corresponds to this height. In such known devices, the checking of the diameter of an inserted coin and the immediate adjustment of the indicator mechanism to the time allotment for the coin are inseparably connected with each other in the device.

All of these proportioning arrangements for a time allotment unit have however the disadvantage that a correspondingly proportioned time unit can be adjusted on the time allowance scale only for a given currency unit. However, great discrepancies may exist between different types of available coins in terms of their payment value. Thus for example a ten cent coin represents twice the value of a five cent coin and a twenty five cent coin, which is the next higher available value, is two and one-half times the value of the ten cent coin and five times the value of the five cent coin. Accordingly, it may be said that the graduation of available coin units immediately signifies or indicates a multiple with respect to the payment value. This observation may be applied in practice for example in a parking meter where it may have been previously necessary to insert a ten cent coin for a parking time allotment of for example thirty minutes and in the case of a price increase for the thirty minute parking time only a twenty five cent coin would be available as the next larger unit of currency. Of course, this would involve an excessive increase in the price of the allotted parking time and since such a price increase would be mandated by the mechanism involved there could be provided no choice regarding a price increase at a lower level. The result would be, among other things, that vehicle operators would be inclined toward seeking parking facilities that did not require payment and that it would be possible to encourage transgressions and unverifiable behavior in the area of stationary traffic.

If it is desired to maintain a determined range of time periods in a parking meter even when the price thereof may be suitably increased, then, referring again to the aforementioned example, a payment of thirty cents for a parking time allotment of thirty minutes may possibly be seen as an acceptable adaptation to the prevailing circumstances. However, the thirty cent amount necessary for adjusting a time allotment period may be comprised of various selections of coins having a value of either five and/or ten cents wherein it would be desirable to avoid requiring a single unalterable combination of coins. In any case, the indication of an allotted time period may only be effected when the amount required for the time allotment is paid by means of inserting a sufficient quantity of money in the form of a quantity of smaller types of coins.

Accordingly, the present invention is directed toward provision of a simple device for adjusting different time units and for clearing the indicator mechanism of a determined time period in a time switching mechanism particularly for use as a parking meter on the basis of several inserted coins which may have differing values.

SUMMARY OF THE INVENTION

Accordingly, the present invention involves a coin activated timer mechanism particularly for use as a parking meter comprising an arrangement of a function lever which operates in a switching or stepping mode and which is dependent on the value of the coin and is cumulatively adjustable in individual steps, the function lever being operatively interposed between a transmission lever which can be deflected in accordance with the value of a coin inserted in the device, a coin testing or sensing device and a time disc or plate which is adjustable for indicating a determined time allotment, wherein the function lever is controlled or guided by the transmission lever in a position which can clear the time indication device and at the same time the disc is controllable in a position adjustable to a determined time allotment.

The device in accordance with the present invention which operates for adjusting the indication of a determined time period provides the general advantage that, in order to trigger or release the indication of an adjustable time unit, it is not required, as was previously customary; that there be available a specific unit of money suited for each adjustable time period or unit. This means that any desired charge rate may be assigned to an already fixed and adjustable parking time period, for example in a parking meter, if the prescribed charge is payable by means of insertion of a suitable coin or quantity of smaller coins amounting to the same value. It is unimportant when inserting a quantity of smaller coins how the assortment or sequence of coins is effected during insertion thereof.

As a result of these measures, there may also be achieved the possibility of dividing any desired charge rate between the values of the required types of coins without the necessity of dispensing with rules or regulations for the payment of a minimum parking time. By means of adjustment of the indicating means to a predetermined parking time period only after payment of the full charge required, the issuance of parking authorization which is visibly indicated by the indication means is accordingly also dependent upon a minimum charge fixed in this manner and this may have a positive effect on surveillance of the devices as well as on the income which can be attained from a parking area. By departing from the previous practice of adjusting the indicating mechanism to a corresponding small or large time unit in direction dependence upon the coin which is inserted, a much greater flexibility is achieved by the mechanism according to the invention in the selection of ratio of charge to time period. Additionally, and in particular, it is also possible to fix the charge rate per time period so that it may be variable between available types of coins.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
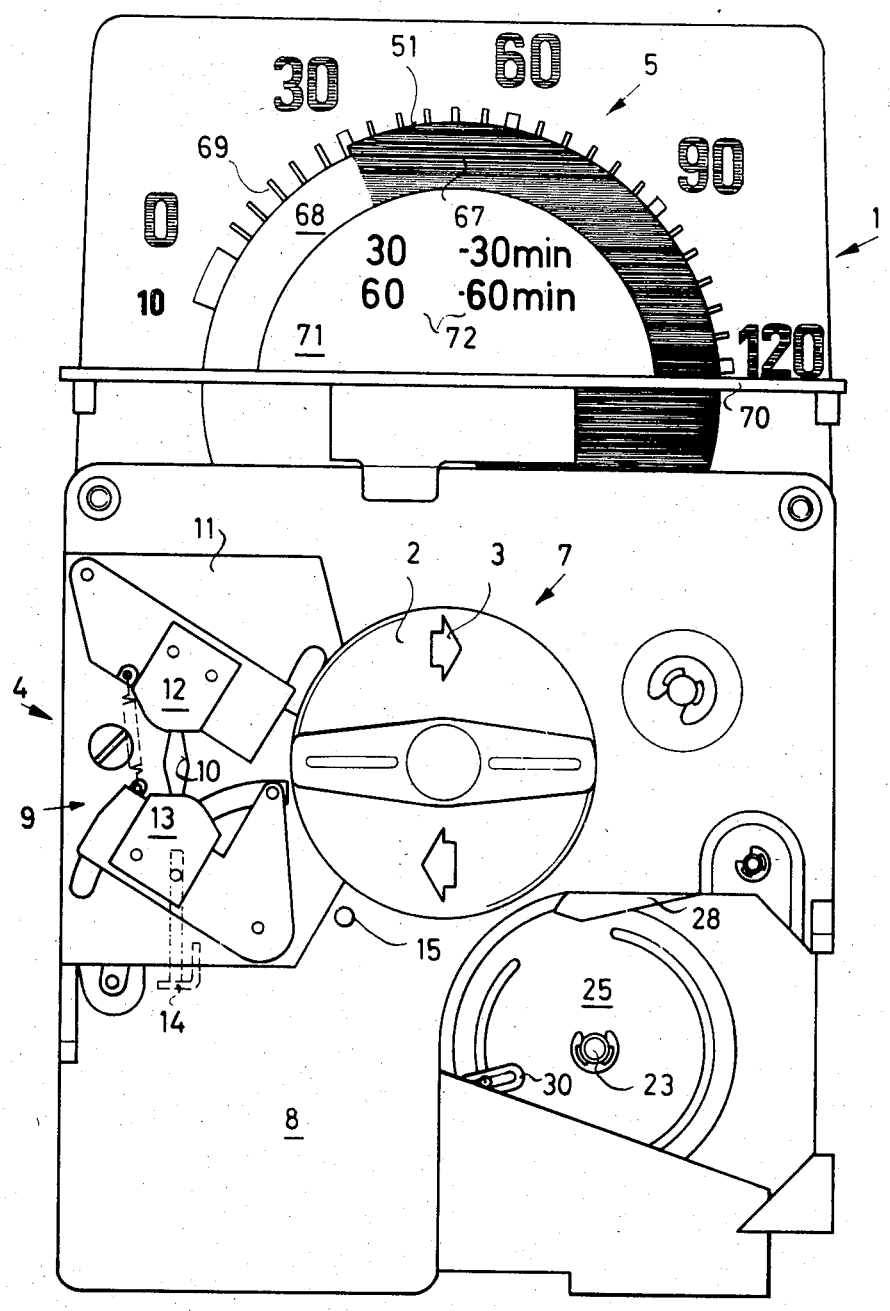
FIG. 1 is a front view of an automatic cashier parking meter wherein a time switching mechanism in accordance with the invention is provided.

Referring now to the drawings, and particularly to FIG. 1, there is shown an automatic cashier parking meter 1 as seen in front view from the viewpoint of a user thereof wherein a housing surrounding the parking meter 1 is omitted for the sake of clarity. As will be seen from FIG. 1, the embodiment shown involves a device which can be wound manually by means of a toggle 2. The directional arrows 3 shown on the toggle 2 symbolically indicate the direction of actuation of the toggle, which in the example shown is rotatable in the clockwise direction for winding and for adjusting the allotted parking time.

Figure 3:
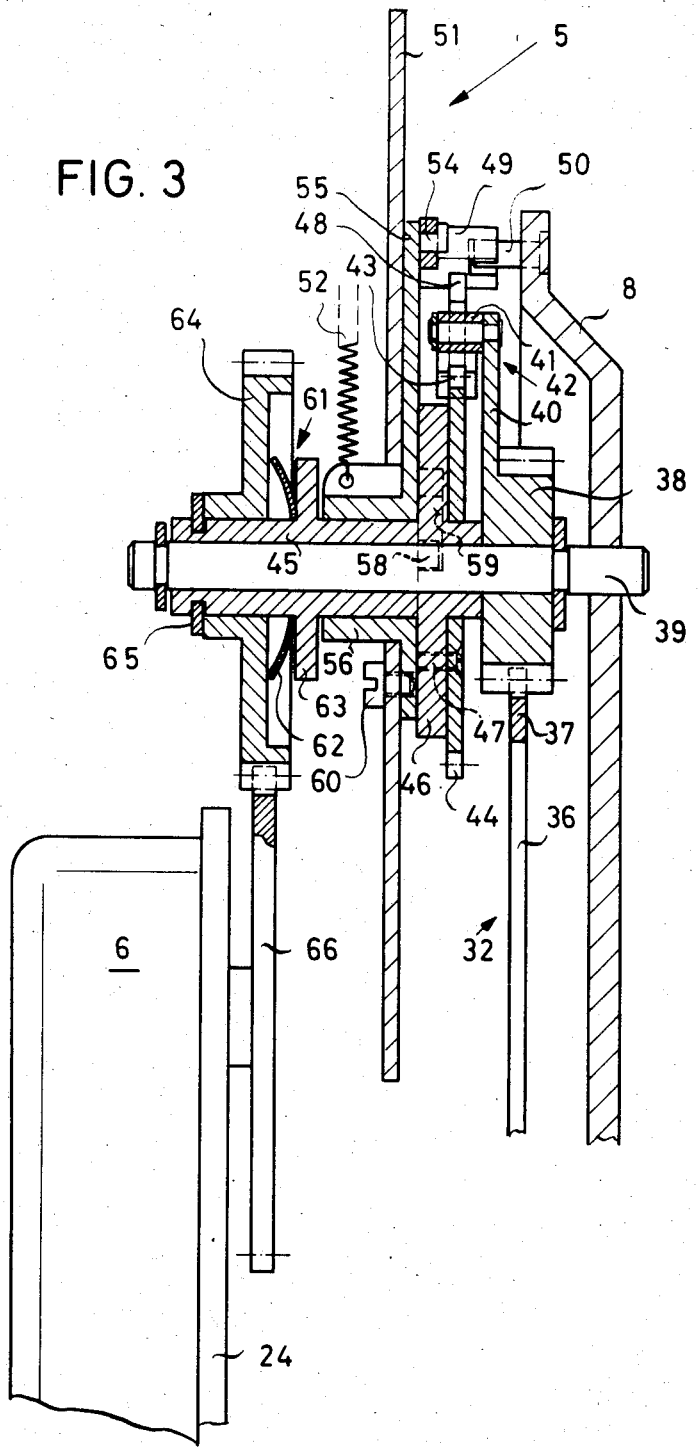
FIG. 3 is a sectional view showing the switching mechanism in accordance with the invention as seen from the side of the device.

As will additionally be seen from the front view of FIG. 1, the parking meter 1 consists essentially of a coin receiving and testing device 4, a time allocation indicating device 5, a clockwork mechanism 6 (see FIG. 3) and an actuation or winding element 7. A coin insertion arrangement 9 having an individual coin insertion slot 10 for all coin sizes is provided in a plate 11 on a bottom plate 8 arranged on the front side. Movable closing segments 12, 13, which close the coin insertion slot 10 and which may be pivoted away from each other simultaneously by means of a coin or similar object, are supported in front of the inserting slot 10. A coin shaft (not shown) through which a coin 19 is guided into a diameter testing or sensing position upon a pivotable support 14 is arranged behind the coin insertion slot 10. The coin testing or sensing device 4 has a twin armed sensing lever 17 which is rotatable on an axle 15 and biased to its return position by means of a spring 16. The lever 17 is driven by the actuating toggle 2 in order to initiate the sensing process by means of a resilient clutch or coupling (not shown).

The twin armed key lever 17 has a sensing arm 18 which operates to sense the diameter of a coin 19 by engaging the coin 19 from above. The lever 17 also contains a bracket arm 20 with a toothed segment 21 which engages a toothed wheel 22 rotatably supported on an axle 23 mounted in a second plate or side wall 24. The toothed wheel 22 is connected with an adjusting disc 25 in rotatively fixed engagement therewith and operates to adjust the disc 25 to a corresponding rotating angular position in accordance with the sensing position of the sensing lever 17 on the basis of the inserted coin 19.

The disc 25 has a cam 26 on its circumference which operates to contact a stop 27 in the initial or starting position of the disc 25. The disc 25 is spring biased to return to its initial or starting position by the spring 16 with the restoring force of the spring 16 acting constantly in the counterclockwise direction.

When the toggle 2 is rotated against the force of the spring 16, the disc 25 is moved from its starting position to a position determined by the operation of the sensing lever 17. As previously indicated, the sensing lever 17 operates to sense or determine the value or diameter of a coin 19 and the position of the disc 25 is temporarily held in a predetermined or particular angular position by means of a pivotable catch claw 28. Additionally, cam elements 30 which are adjustable within an annular groove 29 and which are fastened with a stud 31 in the annular groove 29 are provided on the dial or disc 25. As long as the disc 25 is controlled or guided in the effective area of the catch claw 28, the stud 31 is temporarily held by means of the catch claw 28.

A transmission lever 32 is released by means of elements (not shown in detail) which can be controlled by means of the toggle 2 and the transmission lever 32 is operable to be lowered onto the cam element 30 with a feeler arm 33, with the cam element 30 being adjusted with a determined, radial overhang and with the transmission lever 32 being driven by a torsion spring 34. The transmission lever 32 is pivotably supported on an axle 35 in the side wall 24 and it is peripherally equipped at a second bracket arm 36 with a toothed segment 37 best seen in FIG. 2.

The angular movement of the transmission lever 32 is determined by the dimension of the radial overhang or adjustment of the cam element 30, respectively, and accordingly it represents a criterion for adjustment of a time allotment which is dependent upon a coin value. The position of the cam element 30 in the circumferential direction on the disc or dial 25 is dependent upon the diameter of an inserted and redeemable coin and thus operates to sort out or eliminate coins having an unsuitable diameter.

Figure 2:
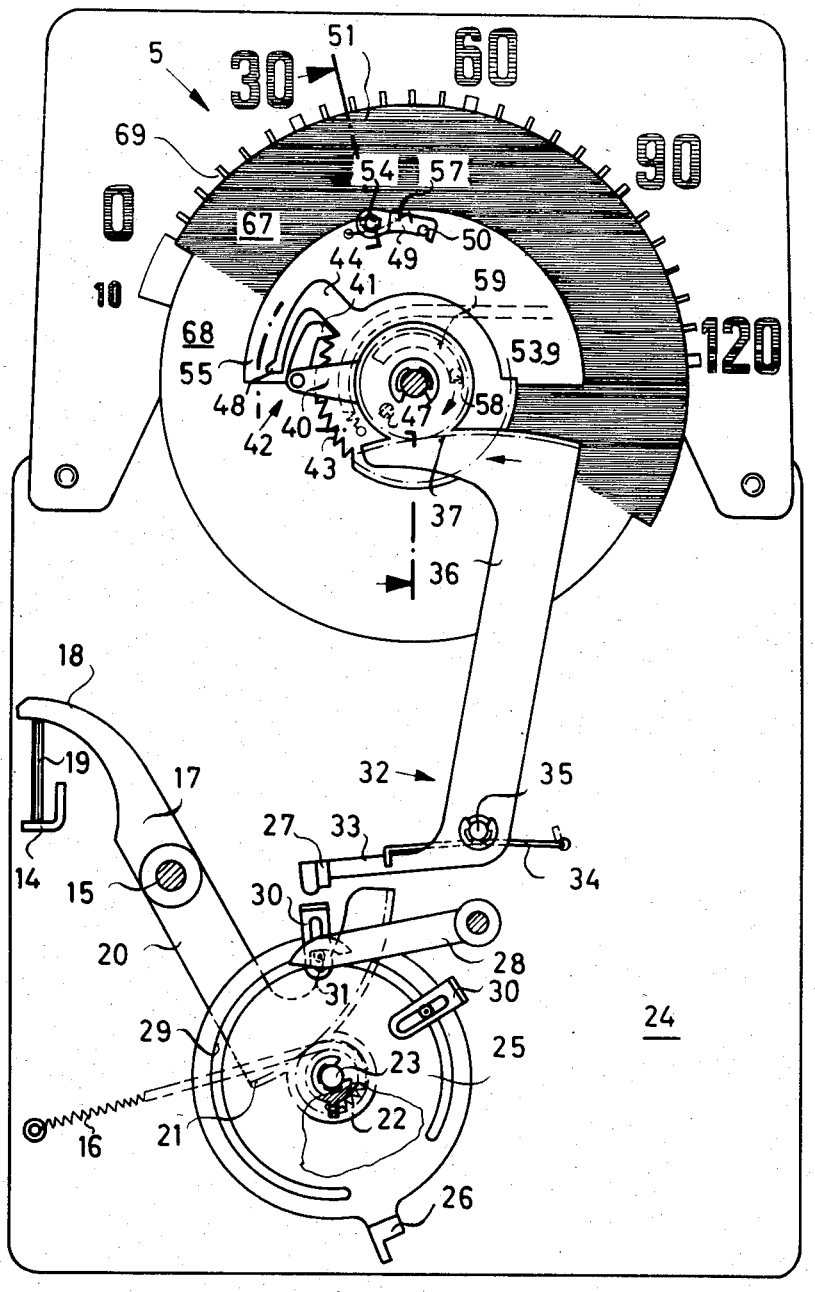
FIG. 2 is a front view of the mechanism of FIG. 1 with parts removed and parts in section showing in greater detail additional elements of the mechanism.

The gear transmission ratio of the movement of the sensing arm 18 during sensing of a coin relative to the angular movement of the cam element 30 at the periphery of the disc 25 is so great that a resolution capacity results by means of which relatively small diameter differences between coins may still provide a discrimination capacity such that there may result an optimum testing and sorting out achievement. This principle of a highly qualified resolution of diameter differences is applied in a similar manner during evaluation of the radial adjustment of the cam elements 30 in the conversion into a time allotment unit. The angular path or distance achieveable by means of lowering the feeler arm 33 on the cam element 30 produces a substantially increased circular dimensioning or measurement at the toothed segment 37 of the longer bracket arm 36 as seen in FIG. 2. Utilizing this factor, the toothed segment 37 engages with a toothed wheel 38 which is rotatably supported coaxially upon a common axle 39 with the indicating device 5.

When the feeler arm 33 moves onto a stopped cam element 30, the transmission lever 32 will move so as to adjust the toothed wheel 38 by rotating it in the clockwise direction as viewed in FIG. 2 through a corresponding angle of rotation. The toothed wheel 38 is provided with a radially projecting switching arm 40 having at the end thereof a ratchet pawl 41 which can be controlled or guided into an engagement position with a spring force. Thus, the toothed wheel 38 with the switching arm 40 and the ratchet pawl 41 form a locking pawl system identified with reference numeral 42 which is supported and movable coaxially relative to the time indication device 5.

Upon movement thereof in the clockwise direction as shown in FIG. 2, the ratchet pawl 41 engages in a toothed segment 43 which is provided peripherally at a function lever 44 in such a manner that the coaxially supported locking pawl system 42, during its movement by means of the transmission lever 32 in the time allotment adjusting direction (in the clockwise direction as seen in FIG. 2) engages in the function lever 44 as a carrier or driver.

The function lever 44 is supported on a hub 45 upon the axle 39. Additionally, a flange 46 is provided at the front of the hub 45 upon which the function lever 44 is adjustably engaged so as to enable a variable angular position thereof by means of being fastened in the desired position for example with a screw as a connecting element 47. Moreover, a radially projecting nose 48 is formed at the function lever 44, which nose 48 is operable to move into the functional area of a pawl 49 during stepwise forward switching of the function lever 44. The nose 48 operates finally to remove the pawl 49 from a locked in position upon a pin 50 which is set in the side wall 8 so as to be fixed in the frame.

The pawl 49 is provided to effect the objective of holding a time disc 51 for example in a starting position so that the time disc 51 will be first prevented from following the action of a tension spring 52 in the direction of time indication. Accordingly, release of the time disc 51 for adjusting a predetermined time period is to be effected only when, by means of inserting a sufficient quantity of redeemable coins, the function lever 44 arrives in individual cumulative steps to the position in which the nose 48 of the function lever 44 removes the pawl 49 from the locked in position with the pin 50. It is only upon occurrence of this operation that the time disc 51 may be actuated into the indicating position of a complete predetermined time period of, for example, thirty minutes, which time period is defined by means of the pawl 49 stopping at another pin 53 which is set so as to be fixed with respect to the frame.

Thus, with the embodiment of the invention depicted and described herein, if it is desired to extend the allotted parking time by a further predetermined time period of for example thirty minutes, the process can be repeated simply by inserting a sufficient quantity of coins. When this is done, the nose 48 will move further in single steps in accordance with the individual coin values in the adjusting direction and thereby remove the pawl 49 at the pin 53 so that the time disc 51 may be actuated to move through a distance representing an additional thirty minutes so that a total time allotment indication of sixty minutes may be provided.

In order to effectuate this functional sequence, the pawl 49 is supported upon an axially projecting peg 54 formed at a flange 55 of a bush 56 and is held in the engagement position by means of a rotating spring. The bush 56 is in turn rotatably supported on the collar of the hub 45 and engages with a carrier cam 58 in a cutout portion 59 having the shape of a circular arc segment in the flange 46 of the hub 45 (see FIGS. 2 and 3). With each adjustment of the time disc 51, the carrier cam 58 contacts the end of the cutout portion 59 and is turned back into the starting position along with the time disc 51 in the counterclockwise direction by means of rotation of the hub in conformity to a clock or reel time. The time disc 51 is connected with the flange 55 by means of a screw so as to be nonrotatable relative to the flange.

In order to return the time indication device to the starting position in accordance with reel time, the hub 45 may be brought into drive connection with a clockwork 6 by means of a friction clutch coupling 61. The friction clutch 61 is composed of an axially active plate or Belleville spring 62 which is arranged between a collar 63 on the hub 45 and a toothed wheel 64 rotatably supported on the hub 45. The toothed wheel 64 contacts the plate spring 62 with sufficient tension and the latter contacts the collar 63 and is axially secured with a securing disc 65. The frictional resistance between the toothed wheel 64 of the spring 62 and the collar 63 on the hub 45 ensures transmission of the drive torque to the time indication device 5 for a return movement of the time disc 51 into the starting position in accordance with clocked or reel time.

The toothed wheel 64 is finally in a gear unit type connection with the clockwork 6 by means of an intermediate gear wheel 66. The clockwork 6 and the intermediate wheel 66 are supported on the bottom plate 24. The clockwork 6 is wound to a determined setting by means of each actuation of the toggle 2, in a manner which need not be described in greater detail.

In order to enable continuous readability of the adjusted or momentary parking time, respectively, the time disc 51 is offset in diameter and is divided into two surfaces 67 and 68 which are made of different colors. This enhances the ability of a user to determine or read the adjusted parking time even from a distance. The time disc 51 moves along a time scale 69 in order to enable accurate determination of the time units which have been purchased or paid for. The centrally arranged drive parts for adjustment and return of the time disc 51 are covered in an advantageous manner with a cover plate 70 and with a half shell member 71 arranged thereon, as will be seen from FIG. 1. The surface of the half shell member 71 is particularly suitable for providing information 72 with respect to the charges for each adjustable time period. Thus, for example, a particular period of time may be indicated for each value of coins deposited.

Thus, it will be seen that in accordance with the invention there is provided a device for enabling adjustment of a determined time period in an automatic cashier time switching mechanism.

The invention is particularly directed to a device for enabling adjustment of different time units and for clearing or release of a determined time period in an automatic cashier time switching mechanism. In a manner divergent from the manner of functioning, in which the time indicating mechanism is adjusted by a corresponding time unit during each insertion of redeemable coins, there is a requirement to indicate a determined time period only when a corresponding charge is paid by means of several, possibly different coins. For this purpose, the function lever 44, which is adjustable in dependence upon the coin value, cumulatively in individual switching steps, is provided between the coin testing device 4 and the time disc 51 which is adjustable to determined allotted periods of time. The function lever 44 is controlled or guided by a locking pawl system 42 in accordance with the value of the coins inserted through a transmission lever 32 in a stepwise manner into a position in which the function lever 44 unlocks the time disc 51 and allows it to be actuated through the predetermined time period to a corresponding indicating position by means of the spring drive 52. The clockwork 6 guides the function lever 44, including the time disc 51, back into the starting position in accordance with the actual expired time.

While a specific embodiment of the invention has been shown and described in detail to illustrate the application of the inventive principles, it will be understood that the invention may be embodied otherwise without departing from such principles.

What is claimed is:

1. A coin activated timer mechanism particularly for use as a parking meter comprising:

a coin receiving device for receiving coins for actuating said mechanism;

sensing means for sensing the value of said coins received by said coin receiving device;

timer indicator means including a timer disc rotatable in individual angular steps for providing an indication of a time period dependent upon the value of coins received by said coin receiving device;

clockwork means for returning said time indicator means to a position indicating expiration of said time period;

a function lever for effecting actuation of said timer disc through said individual angular steps; and a transmission lever interposed between said sensing means and said function lever for actuating said function lever in response to said sensing means;

said function lever being driven by said transmission lever to a position at which said time indicator means is released with said timer disc being at the same time guided to a position indicating a determined time allotment;

said function lever including a toothed ratchet segment at its periphery in which a coaxially supported locking pawl system engages as a carrier.

2. A mechanism according to claim 1 wherein said function lever is supported upon a hub and is adjustable in the circumferential direction in variable angular positions, said mechanism further comprising detachable connecting means for fixing said function lever.

3. A mechanism according to claim 1 wherein said locking pawl system comprises a toothed wheel supported so as to be rotatable upon an axle, said toothed wheel having a radial switching arm at which a locking pawl is provided which is guided in engagement within said toothed ratchet segment by means of spring action.

4. A mechanism according to claim 3 wherein said locking pawl system is in geared connection with said transmission lever by means of said toothed wheel and with said sensing means by means of said transmission lever so as to move said function lever in angular segments depending upon the value of coins sensed by said sensing means into an adjusting position storing a corresponding allotted time.

5. A coin activated timer mechanism particularly for use as a parking meter comprising:

a coin receiving device for receiving coins for actuating said mechanism;

sensing means for sensing the value of said coins received by said coin receiving device;

time indicator means including a timer disc rotatable in individual angular steps for providing an indication of a time period dependent upon the value of coins received by said coin receiving device;

clockwork means for returning said time indicator means to a position indicating expiration of said time period;

a function lever for effecting actuation of said timer disc through said individual angular steps; and a transmission lever interposed between said sensing means and said function lever for actuating said function lever in response to said sensing means;

said function lever being driven by said transmission lever to a position at which said time indicator means is released with said timer disc being at the same time guided to a position indicating a determined time allotment;

said function lever being supported upon a hub and being adjustable in the circumferential direction in variable angular positions;

said mechanism further comprising detachable connecting means for fixing said function lever;

said hub of said function lever having a coaxially extending cutout portion into which a carrier cam of said time indicator means projects.

6. A mechanism according to claim 5 wherein said time indicator means includes a flanged bush and wherein said time disc is adjustable and fastenable upon said bush in the circumferential direction, said carrier cam being provided at said flanged bush so as to project axially with a bearing peg being provided at said flanged bush for rotationally receiving a pawl.

7. A mechanism according to claim 6 wherein said pawl cooperates with pins which can be placed within its active area of movement so as to be fixed with respect to a frame of said mechanism so as to secure said time disc in a time allotted period determined by said pins.

8. A mechanism according to claim 7 wherein said function lever has a nose which removes said pawl from engagement with said pins during movement of said function lever in the position of said pawl and thereby allows said time disc driven by a spring force to be actuated to a position indicating an allotted time period.

9. A mechanism according to claim 6 wherein when a time allotment period is adjusted in said mechanism, said time indicator means is actuated with said carrier cam in an end stop position in said cutout portion of said hub in such a manner that said time indicator means can be brought into driving connection through engagement of said carrier cam with said hub, said mechanism further comprising a friction clutch provided with said clockwork means for returning said time indicating device to a starting position.

* * * * *